US011920596B2

(12) United States Patent
Gödde

(10) Patent No.: US 11,920,596 B2
(45) Date of Patent: Mar. 5, 2024

(54) SCREW COMPRESSOR CONFIGURED TO COMPRESS A PROCESS GAS AND DAMPEN PULSATION WAVES

(71) Applicant: MAN Energy Solutions SE, Augsburg (DE)

(72) Inventor: Ralf Gödde, Recklinghausen (DE)

(73) Assignee: MAN ENERGY SOLUTIONS SE, Augsburg (DE)

( * ) Notice: Subject to any disclaimer, the term of this patent is extended or adjusted under 35 U.S.C. 154(b) by 0 days.

(21) Appl. No.: 18/062,216

(22) Filed: Dec. 6, 2022

(65) Prior Publication Data

US 2023/0204034 A1 Jun. 29, 2023

(30) Foreign Application Priority Data

Dec. 23, 2021 (DE) ..... 10 2021 134 652.5

(51) Int. Cl.

| | |
|---|---|
| ***F04B 39/00*** | (2006.01) |
| ***F01N 1/08*** | (2006.01) |
| ***F04C 2/16*** | (2006.01) |
| ***F04C 15/00*** | (2006.01) |
| ***F04C 29/06*** | (2006.01) |
| ***F04D 29/66*** | (2006.01) |

(52) U.S. Cl.

CPC ..... *F04C 29/061* (2013.01); *F04B 39/0055* (2013.01); *F04C 2/16* (2013.01); *F04C 15/0049* (2013.01); *F04D 29/663* (2013.01); *F04C 2240/30* (2013.01)

(58) Field of Classification Search

CPC ..... F04C 29/12; F04C 15/00; F04C 29/06; F04C 29/063; F04C 29/065; F04C 29/663; F02M 35/00

See application file for complete search history.

(56) References Cited

U.S. PATENT DOCUMENTS

2006/0222547 A1 10/2006 Midorikawa
2015/0198149 A1 7/2015 Lucas et al.

FOREIGN PATENT DOCUMENTS

CN 205714785 U * 11/2016 ..... F04C 29/06
CN 208951509 U * 6/2019 ..... F16L 43/00
DE 3803044 8/1989

(Continued)

OTHER PUBLICATIONS

English translation of CN 208951509 by PE2E Mar. 17, 2023.*

(Continued)

*Primary Examiner* — Deming Wan
(74) *Attorney, Agent, or Firm* — Cozen O'Connor

(57) ABSTRACT

A screw compressor having screw rotors for compressing a process gas, a pipe bend conducting compressed process gas towards a silencer. The pipe bend at an inlet-side portion comprises a first connecting piece fastening the pipe bend to a pressure port and on an outlet-side portion a second connecting piece for fastening the pipe bend to the silencer. The pipe bend has a flow channel between the connecting pieces defined by an inner wall and an insert that projects into the inlet-side portion of the pipe bend. An outer wall of the insert projecting into the flow channel of the pipe bend and a portion of the inner wall of the pipe bend enclosing this outer wall on the outside delimit a space acting as resonator, coupled to the flow channel of the pipe bend.

9 Claims, 3 Drawing Sheets

(56) References Cited

FOREIGN PATENT DOCUMENTS

| | | | | | |
|---|---|---|---|---|---|
| DE | 202007005097 | | | 8/2008 | |
| DE | 102009009168 | | | 8/2010 | |
| DE | 102014212909 | | | 1/2016 | |
| DE | 102015006129 | | | 11/2016 | |
| JP | S 5454309 | | | 4/1979 | |
| JP | H06270252 | A | * | 3/1993 | ..... B29C 63/346 |
| JP | 2019127919 | A | * | 8/2019 | ..... F02M 35/10 |

OTHER PUBLICATIONS

English translation fo CN 205714785 by PE2E Mar. 17, 2023.*
English translation of JP-2019127919 by PE2E Jun. 22, 2023.*
English JP H6270252 by PE2E Dec. 20, 2023.*
Search Report dated Mar. 20, 2023 issued in Great Britain Patent Application No. GB2215016.3.

* cited by examiner

SCREW COMPRESSOR CONFIGURED TO COMPRESS A PROCESS GAS AND DAMPEN PULSATION WAVES

BACKGROUND OF INVENTION

1. Field of the Invention

The disclosure relates to a screw compressor for compressing a process gas.

2. Description of Related Art

The fundamental construction of screw compressors is familiar to the person skilled in the art addressed here. Accordingly, a screw compressor is equipped with a compressor housing. In the compressor housing, screw rotors are mounted that form a rotor pair and serve for compressing a process gas to be compressed. The compressor housing is equipped with a suction port and a pressure port, wherein process gas to be compressed can be fed to the screw compressor via the suction port and wherein compressed process gas can be discharged from the screw compressor via the pressure port.

DE 10 2015 006 129 A1 discloses a screw compressor whose compressor housing comprises a rotor housing portion and an outflow housing portion. The screw rotors of the screw compressor forming a rotor pair are mounted in the rotor housing portion, wherein in the rotor housing portion a control slide is mounted, which serves for changing the effective working space or compression space of the screw compressor.

DE 38 03 044 A1 discloses a further screw compressor. The screw compressor is equipped with a compressor housing having a suction port and a pressure port. By way of the suction port, process gas to be compressed can be fed to the screw compressor, namely the working space or compression space of the same. By way of the pressure port, process gas compressed by the screw compressor can be discharged. DE 10 2009 009 168 A1 discloses a silencer of a screw compressor.

During the operation of a screw compressor, pressure shocks form that result in pulsation waves that can lead to damage in downstream plant components such as for example silencer, cooler or separator.

SUMMARY OF THE INVENTION

There is a need to easily and reliably dampen pulsations. Starting out from this, one aspect of the present invention is based on a new type of screw compressor.

The screw compressor according to one aspect of the invention comprises a compressor housing having a suction port and a pressure port, wherein process gas to be compressed can be fed to the compressor housing via the suction port, and wherein compressed process gas can be discharged from the compressor housing via the pressure port.

The screw compressor according to one aspect of the invention comprises screw rotors mounted in the compressor housing and forming a rotor pair for compressing the process gas.

The screw compressor according to one aspect of the invention comprises a pipe bend that conducts the compressed process gas from the compressor housing in the direction of a silencer, wherein the pipe bend at an inlet-side portion comprises a first connecting piece for fastening the pipe bend to the pressure port of the compressor housing and on an outlet-side portion a second connecting piece for fastening the pipe bend to the silencer, and wherein the pipe bend comprises a flow channel extending between the first connecting piece and the second connecting piece, which is defined by an inner wall of the pipe bend.

The screw compressor according to one aspect of the invention comprises and insert that at the first connecting piece projects in portions into the flow channel of the pipe bend, wherein an outer wall of the insert projecting into the flow channel of the pipe bend and a portion of the inner wall of the pipe bend inclosing this outer wall on the outside delimit a space acting as resonator, which is coupled to the flow channel of the pipe bend.

By way of such an insert for the pipe bend, an effective pulsation damping can be provided. The outer wall of the portion of the insert projecting into the flow channel of the pipe bend and the portion of the inner wall of the pipe bend enclosing the insert on the outside form the space acting as resonator, which makes possible the pulsation damping simply and effectively.

The risk that assemblies such as the silencer arranged downstream of the pipe bend are damaged as a consequence of pulsations is reduced.

The space between outer wall of the insert projecting into the flow channel of the pipe bend acting as resonator and a portion of the inner wall of the pipe bend enclosing this outer wall on the outside can be embodied continuously and thus as an annular space.

The space can also be interrupted by one or more connections between the insert and the inner wall of the pipe bend and thus be subdivided into space portions.

Both the insert and also the wall of the pipe bend can be embodied substantially round in the cross-section, by way of which a substantially cylindrical space materialises.

The insert and/or the wall of the pipe bend can also have different shapes in the cross-section, such as for example an oval or angular shape, as a result of which a shape differing from the cylindrical shape materialises for the space.

The insert can be detachably connected, firmly connected or embodied integrally with the pipe bend.

Preferentially, the inner wall of the pipe bend is contoured cylindrically on the inlet-side portion, wherein the outer wall of the portion of the insert projecting into the flow channel of the pipe bend is contoured cylindrically. By way of this, the resonator can be provided particularly advantageously.

Preferentially, the space forms a $\lambda/4$ resonator. In particular, the length of the portion of the insert projecting into the pipe bend on the inlet-side portion is selected so that the space forms the $\lambda/4$ resonator. By way of the $\lambda/4$ resonator, the pulsation damping is particularly advantageously possible.

Preferentially, the insert comprises a collar that projects from the pipe bend on the inlet-side portion of the same and which delimits the introduction depth of the insert into the pipe bend on the inlet-side portion of the same. Thus, the resonator can be easily provided.

Preferentially, the insert comprises an inner wall that defines a nozzle. This ensures an advantageous flow transition of the compressed process gas emanating from the pressure port of the compressor housing into the pipe bend.

BRIEF DESCRIPTION OF THE DRAWINGS

Preferred further developments of the invention are obtained from the subclaims and the following description.

Exemplary embodiments of the invention are explained in more detail by way of the drawing without being restricted to this. There it shows.

DETAILED DESCRIPTION OF THE PRESENTLY PREFERRED EMBODIMENTS

Figure 1:
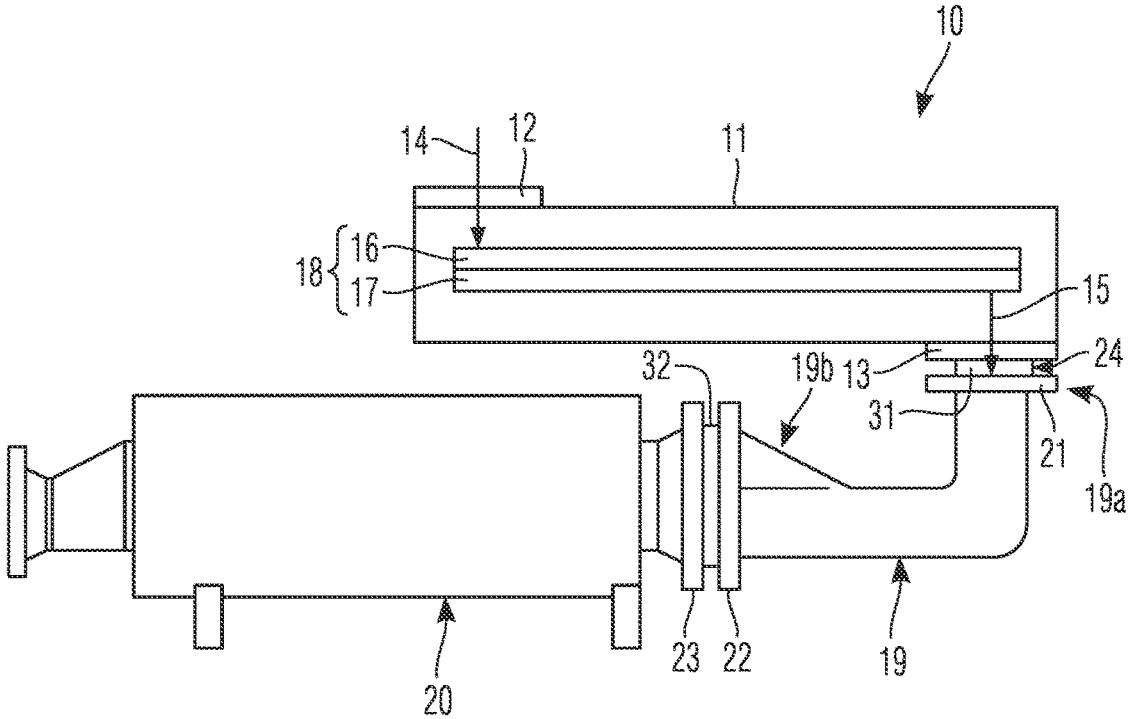
FIG. 1: is a lateral view of a screw compressor.
Figure 2:
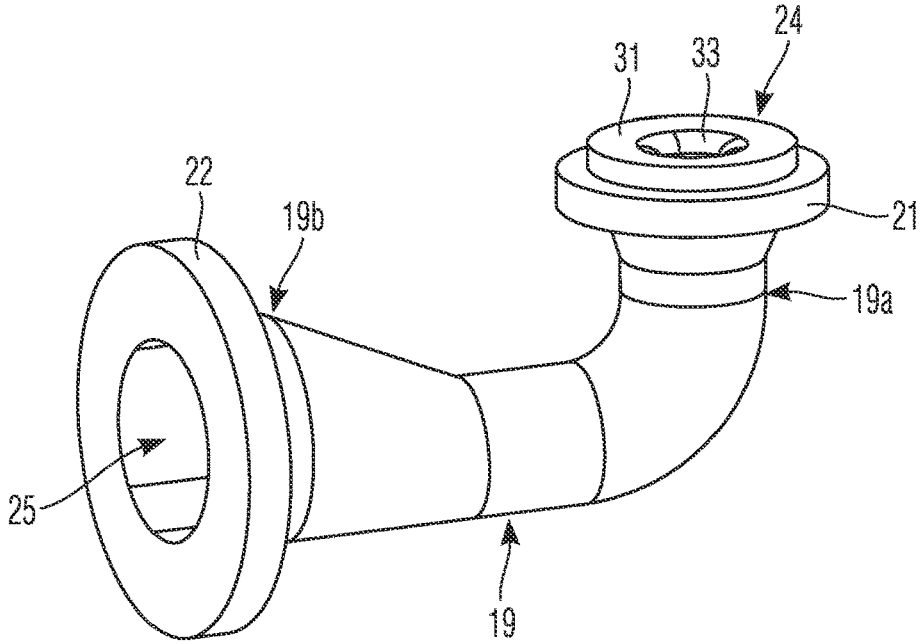
FIG. 2: is a perspective view of a pipe bend of the screw compressor of FIG. 1.
Figure 3:
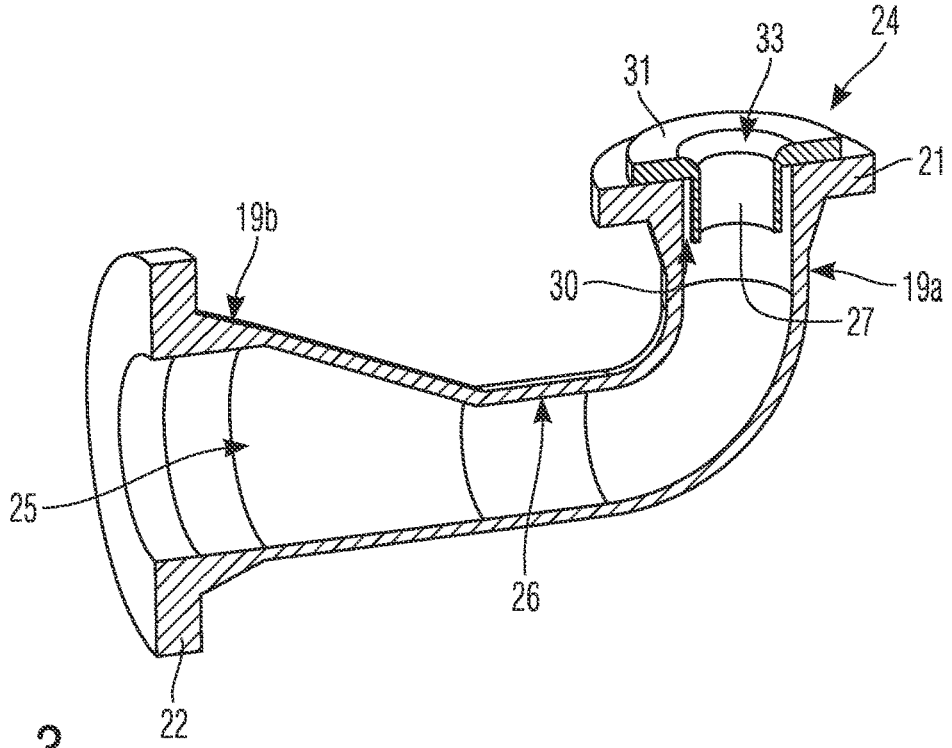
FIG. 3: is a cross-section through FIG. 2.
Figure 4:
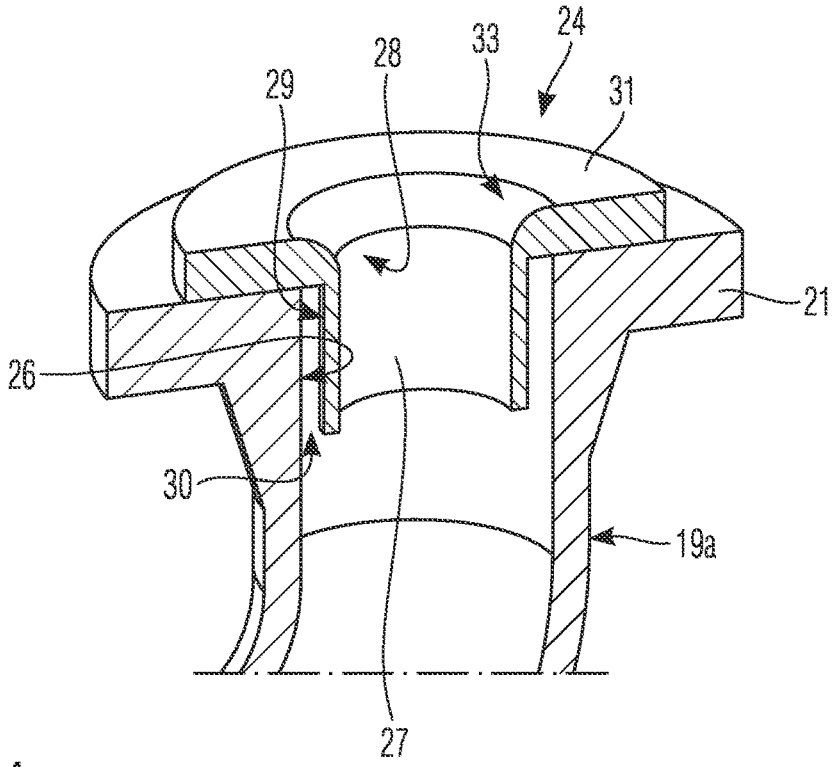
FIG. 4: is a detail of FIG. 3.
Figure 5:
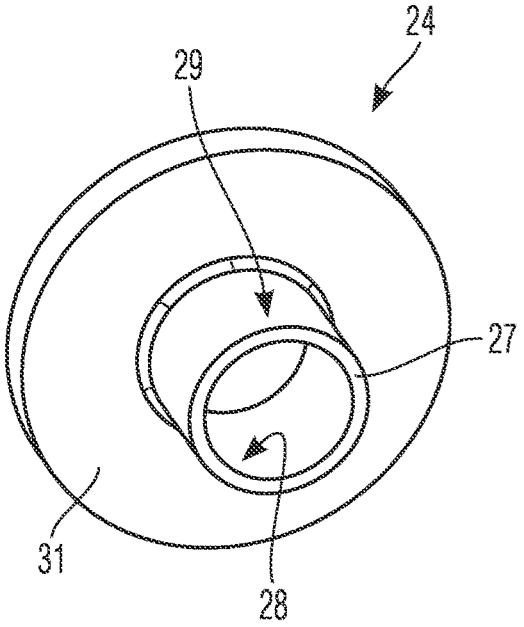
FIG. 5: is a detail of FIG. 2 in a first perspective view.
Figure 6:
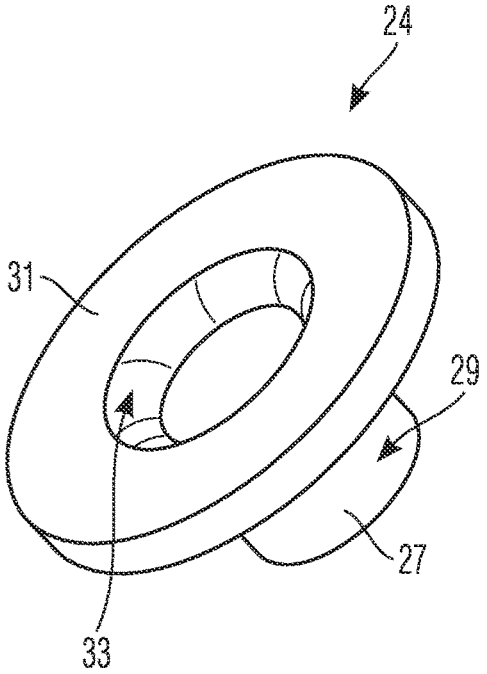
FIG. 6: is a detail of FIG. 5 in a second perspective view.
Figure 7:
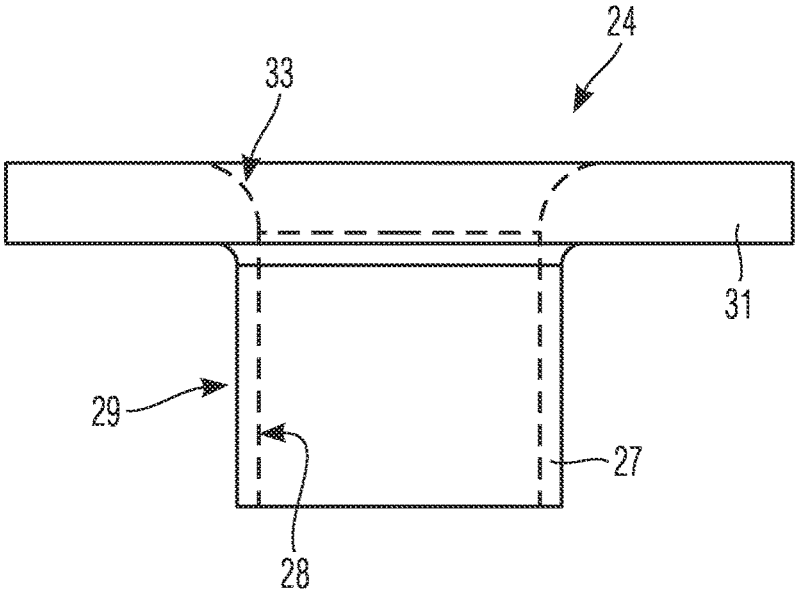
FIG. 7: is a cross-section through the detail of FIG. 5, 6.

FIG. 1 shows a screw compressor 10 for compressing a process gas. The process gas can be for example natural gas.

The screw compressor 10 is equipped with a compressor housing 11 having a suction port 12 and a pressure port 13. By way of the suction port 12, process gas 14 to be compressed can be fed to the compressor housing 11 of the screw compressor 10. Compressed process gas 15 can be discharged from the compressor housing 11 of the screw compressor 10 via the pressure port 13.

In the compressor housing 11, screw rotors 16, 17 are rotatably mounted, which form a rotor pair 18 of the screw compressor 10. The rotor pair 18 consisting of the screw rotors 16, 17 serves for compressing the process gas 14 in a working space or compression space of the compressor housing 11 not shown in more detail. This working space materialises from the interaction of a male rotor tooth with a female rotor tooth gap and the compressor housing enclosing both. The working space reduces in size with increasing rotor rotation.

The compressed process gas 15 can be discharged from this working space or compression space via the pressure port 13 of the compressor housing 11. This occurs for example four times per revolution in the case of four male rotor teeth.

The screw compressor 10, furthermore, is equipped with a pipe bend 19 that conducts the compressed process gas 15, emanating from the pressure port 13 of the compressor housing 11, in the direction of a silencer 20.

The silencer 20 is preferentially an absorption silencer.

The pipe bend 19 is equipped with an inlet-side portion 19*a* and an outlet-side portion 19*b*. On the inlet-side portion 19*a*, a first connecting piece 21 of the pipe bend 19 is formed, via which the pipe bend 19 can be fastened to the pressure port 13 of the compressor housing 11. On the outlet-side portion 19*b* of the pipe bend 19, a second connecting piece 22 for fastening the pipe bend 19 to the silencer 20 is formed, namely at a connecting piece 23 of the silencer 20.

Between the pipe bend 19 and the compressor housing 11, namely between connecting piece 21 of the pipe bend 19 and the pressure port 13 of the compressor housing 11 an insert 24 is arranged which at the first connecting piece 21 projects into a flow channel 25 of the pipe bend 19 in portions. The flow channel 25 of the pipe bend 19 extends between the two connecting pieces 21 and 22 of the pipe bend 19 and in the shown exemplary embodiment is curved by 90° so that accordingly the flow of the compressed process gas, which, emanating from the first connecting piece 21 flows in the direction of the second connecting piece 22 through the flow channel 25 of the pipe bend 19, is redirected. The angle of the redirection can be for example 90° but can also assume other values. The flow channel 25 of the pipe bend 19 is defined by an inner wall 26 of the pipe bend 19.

Dependent on the machine installation, the 90° bend can also be omitted so that the cylindrical part 19*a* is followed by a straight pipe extension.

As already explained, the insert 24 projects into the flow channel 25 in portions in the region of the first connecting piece 21 of the pipe bend 19, namely with a portion 27. The portion 27 of the insert 24, which projects into the flow channel 25 of the pipe bend 19 is formed in a tubular manner and has both an inner wall 28 and also an outer wall 29.

The outer wall 29 of the portion 27 of the insert 24 is enclosed on the outside by the inner wall 26 of the pipe bend 19 in the region of the first connecting piece 21, wherein the inner wall 26 of the pipe bend 19 and the outer wall 29 of the portion 27 of the insert 24 delimit a space 30 that acts as resonator. Both the outer wall 29 of the portion 27 of the insert 24 projecting into the flow channel 25 and also the inner wall 26 of the pipe bend 19, which encloses the outer wall 29 of the portion 27 of the insert 24 radially on the outside are contoured cylindrically, so that the space 30 is defined on the outside by a cylindrical portion of the inner wall 26 of the pipe bend 19 and on the inside by the cylindrical outer wall 29 of the portion 27 of the insert 24 projecting into the flow channel 25.

The resonator, which is formed by the annular gap 30, is preferentially a $\lambda/4$ resonator, wherein the length of the portion 27 of the insert 24 projecting into the pipe bend 19 on the inlet-side portion 19*a* is selected so that the annular gap 30 forms the $\lambda/4$ resonator. The length of the portion 27 of the insert 24 projecting into the pipe bend 19 on the inlet-side portion 19*a* and thus the length of the space 30 acting as resonator is dependent on the expulsion frequency of the compressed process gas 15 in the region of the pressure port 13 and on a sound velocity of the compressed process gas.

The expulsion frequency of the compressed process gas 15 in the region of the pressure port 13 is dependent on the rotational speed of the screw rotors 16, 17. The sound velocity of the compressed process gas is dependent on the type of the compressed process gas and the temperature of the same. The wavelength that is decisive for the resonator effect materialises from expulsion frequency and sound velocity.

Furthermore, the insert 24 is equipped with a collar 31. At the inflow-side portion 19*a* of the pipe bend 19, this collar 31 projects out of the flow channel 25 of the same, wherein the collar 31 delimits the introduction depth of the insert 24 and thus the portion 27 of the same into the pipe bend 19 or the flow channel 25 of the pipe bend 19 on the inlet-side portion 19*a* of the pipe bend 19.

In the mounted state, the collar 31 of the insert 24 is clamped between the pressure port 13 of the compressor housing 11 and the first connecting piece 21 of the pipe bend 19. Fastening elements such as for example fastening screws for fastening the pipe bend 19 to the compressor housing 11 accordingly extend through the first connecting piece 21, but not through the collar 31 of the insert 24.

The inner wall 28 of the insert 24 defines a nozzle 23 with a curved contour in the region of the flange 31. The nozzle 33 is preferentially embodied as venture nozzle. The same ensures an advantageous transition of the compressed process gas 15 from the pressure port 13 of the compressor housing 11 into the pipe bend 19, namely into the insert 24 of the pipe bend 19.

According to FIG. 1, a damper 32 is arranged between the connecting pieces 22, 23, which serve for connecting the pipe bend 19 to the silencer 20, which damper 32 serves for further pulsation damping.

One aspect of the invention allows an effective pulsation damping via the insert 24, which is arranged on the inlet-side portion 19*a* of the pipe bend 19 and with the portion 27 projects into the flow channel 25 of the pipe bend 19 on the inlet-side portion 19*a* of the same while forming the annular gap 30 acting as resonator. Because of the annular gap 30 acting as resonator, sound pressures and sound power levels can be significantly reduced. In the resonance case, a standing wave in the space 30 which is formed by the outer wall 29 of the portion 27 of the insert 24 and the inner wall 26 of the flow channel 25 of the pipe bend 30 on the inlet-side portion 19*a* of the pipe bend 19, is subjected to a phase reversal of 180°, as a result of which a cancellation effect in a passing wave front is generated. Thus it is particularly effectively possible to reduce sound pressures and sound power levels and provide a pulsation damping on the screw compressor 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A screw compressor configured to compress a process gas, comprising:

a compressor housing having a suction port and a pressure port, wherein the process gas to be compressed is fed to the compressor housing via the suction port and compressed process gas is discharged from the compressor housing via the pressure port;

screw rotors mounted in the compressor housing and forming a rotor pair configured to compress the process gas;

a pipe bend, which conducts the compressed process gas from the compressor housing in a direction of a silencer, comprising:

a first connecting piece for fastening the pipe bend to the pressure port of the compressor housing at an inlet-side portion of the pipe bend, wherein the first connecting piece has a substantially planar surface;

a second connecting piece for fastening the pipe bend to the silencer, an outlet-side portion of the pipe bend; and a flow channel extending between the first connecting piece and the second connecting piece, which is defined by an inner wall of the pipe bend;

an insert on the inlet-side portion of the pipe bend that projects into the flow channel of the pipe bend at least in portions, wherein the insert comprises:

a collar that projects out of the pipe bend on the inlet-side portion, and which delimits an introduction depth of the insert into the pipe bend on the inlet-side portion and a portion of the insert projects into the flow channel of the pipe bend, wherein the collar forms a first planar surface that faces the pressure port; and a second planar surface that faces the first connecting piece, the portion of the insert that projects into the flow channel extends longitudinally from the planar surface, wherein the portion of the insert that projects into the flow channel extends longitudinally from the planar surface and does not extend beyond the planar surface;

an inner wall of the insert defines a nozzle facing the pressure port between the insert and the collar, and an outer wall of the insert projects into the flow channel of the pipe bend and a portion of the inner wall of the pipe bend enclosing the outer wall on an outside delimits a space acting as a resonator, which is coupled to the flow channel of the pipe bend.

2. The screw compressor according to claim 1, wherein the flow channel of the pipe bend is substantially curved by 90° between the inlet-side portion and the outlet-side portion.

3. The screw compressor according to claim 2, wherein the inner wall of the pipe bend on the inlet-side portion is contoured cylindrically, and the outer wall of the portion of the insert projecting into the flow channel of the pipe bend is contoured cylindrically.

4. The screw compressor according to claim 1, wherein the space acting as the resonator is an annular space.

5. The screw compressor according to claim 1, wherein the space forms a $\lambda/4$ resonator.

6. The screw compressor according to claim 5, wherein a length of the portion of the insert projecting into the pipe bend on the inlet-side portion and thus the length of the space acting as the resonator is dependent on an expulsion frequency of the compressed process gas on the pressure port and on a sound velocity of the compressed process gas.

7. The screw compressor according to claim 6, wherein the expulsion frequency of the compressed process gas is dependent on a rotational speed of the screw rotors and the sound velocity of the compressed process gas on a temperature of the compressed process gas.

8. The screw compressor according to claim 1, wherein a length of a portion of the insert projecting into the pipe bend on the inlet-side portion is selected so that the space forms a $\lambda/4$ resonator.

9. The screw compressor according to claim 1, wherein the collar of the insert is clamped between the pressure port of the compressor housing and the first connecting piece of the pipe bend.

* * * * *